US007288347B2

(12) United States Patent
Sanders et al.

(10) Patent No.: US 7,288,347 B2
(45) Date of Patent: Oct. 30, 2007

(54) METHOD OF APPLYING SPOT VARNISH TO XEROGRAPHIC IMAGE AND EMULSION AGGREGATION TONERS FOR USE THEREIN

(75) Inventors: David J. Sanders, Oakville (CA); Raj D. Patsetl, Oakville (CA); Michael A. Hopper, Toronto (CA)

(73) Assignee: Xerox Corporation, Stamford, CT (US)

( * ) Notice: Subject to any disclaimer, the term of this patent is extended or adjusted under 35 U.S.C. 154(b) by 420 days.

(21) Appl. No.: 10/929,411

(22) Filed: Aug. 31, 2004

(65) Prior Publication Data

US 2006/0046180 A1 Mar. 2, 2006

(51) Int. Cl.
*G03G 17/04* (2006.01)
*G03G 15/08* (2006.01)
*G03G 9/00* (2006.01)

(52) U.S. Cl. ..... 430/33; 430/92; 430/104

(58) Field of Classification Search ..... 430/33, 430/92, 104
See application file for complete search history.

(56) References Cited

U.S. PATENT DOCUMENTS 4,040,828 A 8/1977 Evans
4,061,833 A 12/1977 Pelletier et al.
4,965,131 A * 10/1990 Nair et al. ..... 430/110.2
5,227,460 A 7/1993 Mahabadi et al.
5,234,783 A 8/1993 Ng
5,376,494 A 12/1994 Mahabadi et al.
5,480,756 A 1/1996 Mahabadi et al.
5,500,324 A 3/1996 Mahabadi et al.
5,575,954 A 11/1996 Mahabadi et al.
5,721,432 A 2/1998 Gwaltney
5,751,432 A * 5/1998 Gwaltney ..... 358/296
5,763,133 A * 6/1998 Ong et al. ..... 430/137.14
5,912,097 A * 6/1999 Aslam et al. ..... 430/47
6,120,967 A 9/2000 Hopper et al.
6,132,924 A 10/2000 Pater et al.
6,268,102 B1 7/2001 Hopper et al.
6,365,318 B1 4/2002 Moffat et al.
6,447,974 B1 9/2002 Chen et al.
6,495,302 B1 12/2002 Jiang et al.
6,500,597 B1 12/2002 Pater et al.
6,535,712 B2 3/2003 Richards
6,541,175 B1 4/2003 Jiang et al.
6,576,389 B2 6/2003 Van Beisen et al.
6,617,092 B1 9/2003 Pater et al.
6,664,017 B1 12/2003 Pater et al.
6,673,500 B1 1/2004 Pater et al.
6,828,073 B2 * 12/2004 Matsumura et al. ..... 430/108.1
2005/0135851 A1 * 6/2005 Ng et al. ..... 399/341
2005/0137278 A1 * 6/2005 Fromm et al. ..... 522/100
2005/0207807 A1 * 9/2005 Tombs ..... 399/341

* cited by examiner

*Primary Examiner*—Mark F. Huff
*Assistant Examiner*—Peter Vajda
(74) *Attorney, Agent, or Firm*—Eugene O. Palazzo; Oliff & Berridge, PLC

(57) ABSTRACT

A method of forming a xerographic image having at least one portion with a gloss different from a gloss of another portion of the xerographic image includes xerographically forming a toner image on a surface of a substrate and forming a finish over the toner image at the at least one portion, the finish being made of a differential gloss finish coating material that has a gloss different from that of the toner image. The differential gloss finish coating material is preferably an emulsion aggregation toner that is substantially free of pigments that adversely affect the transparency of the toner following fusing, the toner having gloss tunability through control of the amount of crosslinked portions included in the toner.

16 Claims, No Drawings

METHOD OF APPLYING SPOT VARNISH TO XEROGRAPHIC IMAGE AND EMULSION AGGREGATION TONERS FOR USE THEREIN

BACKGROUND OF THE INVENTION

1. Field of Invention

Embodiments of the present invention relate to a method of applying a spot varnish to selected areas of a xerographic image, thereby achieving a xerographic image having different image regions with different gloss finish appearance. Further embodiments of the invention relate to emulsion aggregation toners having gloss tunability that are used as the spot varnish material.

2. Description of Related Art

In printing full color images by offset press, the gloss of the image is usually determined by the gloss of the paper being printed. In other words, to make a glossy image on an offset press, one would use a glossy (usually coated) paper, while to make a matte image, one would use a matte (uncoated or matte coated) paper. This is because in an offset press, a thin layer of ink is laid down which follows the surface roughness of the substrate. In some cases however, one would like to have certain areas of a single page appear glossy, while other areas appear matte. This can produce aesthetically striking results because glossy color images tend to have much more vibrant colors than matte color images. In an offset press, this selective gloss can be achieved by the application of spot varnish. This is a transparent ink coating that is applied over selected areas of a full color offset print to impart gloss to those areas.

Compared to offset presses, xerographic engines deposit a relatively thick toner layer on the paper, and thus to some degree the gloss of a color xerographic image can be controlled independently of the gloss of the substrate. The gloss of a xerographic image is determined largely by the toner mass per unit area (TMA) that is deposited on the substrate, by the melt rheological properties of the toner, and also by the nature and texture of the fuser roll that contacts the image during the fusing step. For example, XEROX highlight color machines such as 4850 and 4890 produce matte color images, while XEROX pictorial color machines produce glossy full color images even on matte uncoated paper. Neither type of machine, however, currently has the capability of producing a color page in which part of the page is glossy, and part is matte.

Moreover, newer high speed, full color xerographic machines are meant to compete with offset presses for short run color printing. If such machines are to effectively compete with offset presses, they must offer all the capabilities of an offset press, including the ability to provide spot varnish.

Accordingly, there is a need for a xerographic equivalent of a spot varnish application in offset printing.

SUMMARY OF THE INVENTION

These and other objects of the present invention are achieved by way of a method of forming a xerographic image having at least one portion with a gloss different from a gloss of another portion of the xerographic image, comprising xerographically forming an image comprised of toner on a surface of a substrate, and forming a finish over the image comprised of toner at the at least one portion, the finish comprised of a differential gloss finish coating material that has a gloss different from that of the image comprised of toner.

In further embodiments, the invention relates to a method of preparing a xerographic image having different gloss properties at different portions of the image, comprising xerographically forming an image comprised of toner on a surface of a substrate, and at selected portions of the image, and not at an entirety of the image, applying an emulsion aggregation toner that is substantially free of pigments that adversely affect the transparency of the toner following fusing.

In another embodiment, the invention relates to a differential gloss finish coating material that is comprised of an emulsion aggregation toner that is substantially free of pigments that adversely affect the transparency of the toner following fusing, the toner being comprised of linear portions and including crosslinked portions in an amount of from 0% by weight to about 50% by weight of the toner.

DETAILED DESCRIPTION OF PREFERRED EMBODIMENTS

In embodiments of the present invention, a spot varnish or differential gloss finish coating material is applied to selected areas of a xerographic image. In this invention, the term spot varnish or differential gloss finish coating material is intended to refer to a coating material applied over a xerographic image on a side of the image opposite a substrate, the coating material imparting a different gloss property to areas of the xerographic image where it is applied. The gloss level imparted by the coating material may range from matte to high gloss.

Hereinafter, gloss units refer to TAPPI T480 75° specular gloss unless otherwise indicated. The higher the gloss unit, the higher the gloss of the image. Thus, for example, high gloss images have a gloss unit of, for example, 25 gloss units or more, whereas low gloss or matte images have a gloss unit of about 15 gloss units or less.

In embodiments of the present invention, it is preferred that the differential gloss finish coating material impart a gloss that is at least about 5 gloss units, preferably at least about 10 gloss units, different from the gloss of a xerographic toner image formed on a substrate. In this manner, the gloss difference is noticeable by the human eye, and thus an image having an appearance of different gloss portions across the image is witnessed.

Example methods by which the differential gloss finish coating material may be applied are first discussed below, followed by a discussion of preferred materials of the differential gloss finish coating material.

In the present invention, there is no limitation to the methods that may be used to form the initial xerographic image upon the substrate, and any suitable method may be used without limitation. In xerography, a xerographic image is formed from an original image in a method in which an electrophotographic imaging member or plate is imaged by first uniformly electrostatically charging the surface of the photoconductive insulating layer. The plate is then exposed to a pattern of activating electromagnetic radiation, for example light, which selectively dissipates the charge in the illuminated areas of the imaging member or plate. An electrostatic latent image is formed, which may then be developed to form a visible image by depositing finely divided electroscopic toner particles, for example from a developer composition, on the surface of the imaging member or plate. The resulting visible toner image can be transferred to a suitable receiving member such as paper. This imaging process may be repeated many times with reusable photosensitive members.

In the present invention, there is thus no limit upon the methods by which the electrostatic latent image is formed, by which the toner particles are deposited or by which the image is formed and/or transferred to an image receiving substrate such as paper. Further, the xerographic image formed may be a single color image, such as black, or it may be comprised of multiple colors, including, for example, cyan, yellow, magenta and/or black, as well as any number of other colors. Multiple color images may be formed in registration upon the imaging member or plate surface, or may be formed by transferring each color image from separate development stations in registration to the image receiving substrate.

In embodiments of the present invention, the differential gloss finish coating material can be applied to an existing xerographic image by a dedicated machine that develops, transfers and fuses the differential gloss finish coating material onto an already fused xerographic print. This is an off-line method because the application of the differential gloss finish coating material does not occur until after the xerographic image is completely formed and fused.

In this off-line procedure, the complete xerographic image is first formed and fused upon an image receiving substrate surface. Then, the differential gloss finish coating material is applied to the existing xerographic image by the downstream dedicated machine. The differential gloss finish coating material is preferably applied directly upon the exposed surface of the xerographic image, i.e., the surface that is opposite the substrate. Once applied, the differential gloss finish coating material is preferably fused.

If the original print is matte, selected areas can by made glossy by applying and developing a glossy finish coating material to those areas, while if the original print is glossy, the complementary areas can be rendered matte by applying and developing a matte finish coating material to those areas.

In this embodiment, if glossy areas are added to an already fused matte xerographic image, it is important that the undeveloped areas of the image (i.e., those areas of the xerographic image where no differential gloss finish coating material is applied) remain matte after passing through the fuser of the spot varnish device. Similarly, if matte areas are added to a glossy image, it is necessary that undeveloped areas not be overheated in the fuser of the spot varnish device, and thus lose gloss.

In order to accurately control the difference in gloss between the glossy and matte areas of the end print, it may be useful in embodiments of the invention to develop both glossy and matte transparent finish coating materials onto complementary areas of an existing xerographic print (either matte or glossy). The glossy and matte transparent finish coating materials could be imaged, for example, in a two-cycle device with one photoreceptor and two development housings, or in a tandem device with two photoreceptors and two development housings. In either case, the developed transparent finish coating material images could be transferred directly to the substrate, or to an intermediate transfer surface, for example of an intermediate transfer belt, with subsequent transfer to the substrate. Alternately, a xerographic engine based on trilevel xerography, which develops two toners side-by-side in a single pass, could be used for realizing this embodiment of the invention. The glosses of the glossy and matte finishes in this embodiment preferably differ by at least about 5 gloss units, more preferably by at least about 10 gloss units.

In a further embodiment of the present invention, the differential gloss finish coating material can be applied in an on-line method in which the finish coating material is applied during development of the xerographic image with color toner(s).

High speed color xerographic printers produce full color images by several methods, as mentioned above. For example, some devices use a tandem architecture in which four colors such as yellow, magenta, cyan and black images are each developed onto one of four photoreceptors, and sequentially transferred to an intermediate transfer surface such as an intermediate transfer belt. The color developed image is then transferred in a single pass to a substrate such as paper, and subsequently passed through a fuser to permanently fix the image. Other devices use image-on-image (IOI) technology. In this process, four developer stations are used to sequentially develop magenta, yellow, cyan and black toners onto a single photoreceptor belt, and the developed color image is then transferred directly to a substrate such as paper in a single pass, and subsequently passed through a fuser to permanently fix the image.

In this embodiment of the invention, an additional development unit could be added to the xerographic device used to form the xerographic image. This additional unit would be used to apply the differential gloss finish coating material during development of the xerographic image by the xerographic device. For a tandem architecture, this requires the addition of a fifth photoreceptor with a fifth development station, while for IOI technology, it requires only the addition of a fifth development station to the single photoreceptor belt. In each embodiment, the transparent differential gloss finish coating material would be the first aspect of the image transferred to the intermediate transfer surface in the case of a tandem device, or developed onto the photoreceptor belt in the case of an IOI device, since in either case, after transfer to the substrate the first image becomes the uppermost layer on the toner image.

Here again, it must be emphasized that any technique for forming images using photoreceptor development devices may be used without limitation.

Suitable materials for the differential gloss finish coating material will now be described. Preferably, the finish coating material is transparent at least after fusing, i.e., it does not substantially obscure viewing of the toner images thereunder, and preferably also does not substantially alter the color of the underlying image. The finish coating material most preferably affects only the gloss of the underlying image.

Furthermore, the finish coating material preferably has characteristics similar to toners, since the material is preferably applied in a manner similar to the toners of the xerographic image. The differential gloss finish coating material is thus preferably a substantially unpigmented toner. By substantially unpigmented or substantially free of pigments is meant that the toner is substantially free of pigments that adversely affect the transparency of the toner following fusing. The toner should develop an adequate tribocharge, which should not be dependent on the presence of pigment in the toner. Further, the toner should preferably be available in versions that could become either glossy or matte when passed through the same fuser, i.e., the toner should have ready gloss tunability.

In a most preferred embodiment of the present invention, the differential gloss finish coating material is an emulsion aggregation toner that is substantially free of coloring agents that adversely affect the transparency of the toner. Emulsion aggregation toner manufacturing methods are very well known in the art. As but a few examples of references describing emulsion aggregation toners and the method of making them, mention may be made of U.S. Pat. Nos. 5,290,654, 5,278,020, 5,308,734, 5,364,729, 5,370,963, 5,344,738, 5,403,693, 5,418,108, 5,346,797, 5,853,943, 5,922,501, 6,120,967, 6,132,924, 6,268,102, 6,500,597, 6,495,302, 6,541,175, 6,617,092, 6,664,017, and 6,673,500. Typically in the process, resin is prepared from a starting monomer or mixture of monomers as a water based dispersion of sub-micron sized polymeric particles (polymeric latex), i.e., by emulsion polymerizing the starting monomer or mixture of monomers, and these particles are then aggregated, preferably with pigment particles of sub-micron size, to the desired toner size and are then coalesced to produce pigmented toner particles. The process permits formation of toner particles having a narrow particle size distribution that can be achieved without classification. Pigmentless emulsion aggregation toners can be prepared by the same process without the addition of pigment particles.

Such pigmentless emulsion aggregation toners, without additives, can generate a reasonable tribocharge against a variety of xerographic carriers, and in fact, the pigmentless toners have slightly higher negative tribocharge than toners produced from the same latex polymer with cyan, magenta or yellow pigments added.

Most significantly to the present invention, substantially pigmentless emulsion aggregation acrylate toners have been found to have a tunable gloss property, primarily depending on how much crosslinked gel particle content is present in the toner. As detailed in a number of references, for example including U.S. Pat. Nos. 5,575,954, 5,500,324, 5,376,494, 5,227,460, 6,120,967, 6,132,924, 6,268,102, 6,500,597, 6,495,302, 6,541,175, 6,617,092, 6,664,017, and 6,673,500, each of which is incorporated herein by reference in its entirety, toners can be prepared to have both linear lower density portions and crosslinked higher density portions, the relative proportions of each being controlled by any number of suitable techniques. U.S. Pat. No. 5,763,133, also incorporated herein by reference in its entirety, specifically teaches a method for preparing emulsion aggregation toners wherein there is accomplished the aggregation of latex, pigment particles, and optional additives to enable toner compositions with specific image gloss characteristics through control of the amount of crosslinked polymer particles therein. It is described that the image gloss characteristics of the toner are controlled primarily by the amount of the crosslinked polymer particles utilized, their particle size, crosslink density, and composition. Lower image gloss levels, i.e., matte characteristics, are obtained from toners with higher contents and larger particle size of crosslinked polymer, whereas higher gloss image levels are obtained when the amount of crosslinked polymer particles is very low to none.

Thus, the gloss of the substantially pigmentless emulsion aggregation toners of the invention can be tuned by aggregating and coalescing two lattices: one the normal latex with a fairly low molecular weight for high gloss, and the other a crosslinked latex (gel) of the same formulation for low gloss (matte). As the amount of crosslinked gel is increased, the gloss properties of the toner vary from highly glossy to matte, when fused in a typical soft-roll fuser. Moreover, by varying the gel content, the gloss properties of the emulsion aggregation toner can be varied without changing its low melt fix characteristics.

Illustrative examples of latex resins or polymers selected for the non cross linked resin and cross linked resin or gel of the present invention include known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. A preferred resin or polymer is a styrene/butyl acrylate/carboxylic acid terpolymer.

The preferred non cross linked latex comprises styrene, butylacrylate, and beta-carboxy ethyl acrylate (beta-CEA) monomers, although not limited to these monomers, termed herein as monomers A, B and C, and is preferably prepared by emulsion polymerization in the presence of an initiator, a chain transfer agent (CTA), and surfactant. The non cross linked resin monomers are preferably present in a ratio of about 70:30:3 pph to about 90:10:3 pph A, B, C, respectively, although the carboxylic acid is not limited and can be selected from the group comprised of acrylic acid, methacrylic acid, itaconic acid, beta carboxy ethyl acrylate (beta CEA), fumaric acid, maleic acid, and cinnamic acid, and wherein a carboxylic acid is selected in an amount of from about 0.05 to about 10 weight percent. Examples include poly(styrene butyl acrylate beta carboxy ethyl acrylate), poly(styrene butadiene beta carboxy ethyl acrylate), poly(styrene isoprene beta carboxy ethyl acrylate), poly(styrene butyl acrylate, acrylonitrile beta carboxy ethyl acrylate), and poly(styrene butyl acrylate, divinyl benzene beta carboxy ethyl acrylate).

The initiator may be, for example, but is not limited to, sodium, potassium or ammonium persulfate, and is preferably present in the range of about 0.5 to about 5.0 percent based upon the weight of the monomers. The CTA is preferably present in an amount of from about 1.5 to about 5.0 percent by weight based upon the combined weight of the monomers A and B. The surfactant is preferably an anionic surfactant present in the range of about 0.7 to about 5.0 percent by weight based upon the weight of the aqueous phase, although the invention is not limited to this type or range.

The monomers are polymerized under starve fed conditions as referred to in Xerox patents such as U.S. Pat. NoS. 6,447,974, 6,576,389, 6,617,092, and 6,664,017, which are hereby incorporated by reference herein in their entireties, to provide latex resin particles having a size in the range of about 100 to about 300 nanometers in size.

The weight average molecular weight of the non cross linked latex resin is preferably from about 30,000 to about 37,000, preferably about 34,000, although not limited to this range.

The onset glass transition temperature (TG) of the non cross linked resin is not limited, but is preferably in the range of, for example, from about 46° C. to about 60° C., preferably about 54° C.

Preferably, the amount of carboxylic acid groups is selected in the range of about 0.04 to about 10.0 pph of the resin monomers A and B.

The Mn is from about 6,000 to about 15,000, preferably about 11,000.

The prepared non cross linked latex resin preferably has a pH of about 1.5 to about 3.0, most preferably about 2.0.

A cross linked latex is prepared by selecting the polymeric latex resin from the list above, and the preferred resin comprises styrene, butylacrylate, beta-CEA, and divinyl benzene, termed herein as monomers A, B, C, and D, and then by emulsion polymerization, in the presence of an initiator such as a persulfate, a CTA, and surfactant. The cross linked resin monomers are preferably present in a ratio of about 60:40:1 pph:0.5 pph to about 80:20:10 pph:10 pph A, B, C, and D, respectively although the invention is not limited to these particular types of monomers or ranges. Most preferably, the monomer composition comprises from about 65% styrene, 35% butylacrylate, 3 pph beta-CEA, and 1 pph divinyl benzene, although the composition is not limited to these amounts.

The Tg (onset) of the cross linked latex is about 45° C. and the degree of cross linking is in the range of about 2 to about 20 percent, although the invention is not limited thereto, since an increase in the divinyl benzene concentration will increase the cross linking.

The soluble portion of the cross linked latex preferably has a Mw of about 135,000 and a Mn of about 27,000 but is not limited thereto.

The particle size of the cross linked latex is about 50 nanometers, although not limited, and can be in the range of about 50 to about 150 nanometers.

Thus, a preferred toner of embodiments of the invention is preferably comprised of linear portions and crosslinked portions, the crosslinked portions being present in an amount of from 0% by weight, preferably 0.1% by weight, to about 50% by weight of the toner, preferably in an amount of from about 1% by weight to about 45% by weight of the toner. The higher the amount of the crosslinked portions, the lower the gloss of the toner.

In a preferred embodiment of the invention, a glossy transparent emulsion aggregation toner is produced by aggregating and coalescing a low molecular weight styrene-butyl acrylate-carboxylic acid latex, with substantially no pigment and substantially no crosslinked portions, into toner sized particles. A matte transparent emulsion aggregation toner is similarly made by the same procedure by combining the same low molecular weight styrene-butyl acrylate-carboxylic acid latex with about 15%, preferably about 25%, by weight of the toner of a crosslinked version of the styrene-butyl acrylate-carboxylic acid latex, followed by aggregation and coalescence of the latex blend.

In a preferred embodiment of the present invention, the differential gloss finish toner is comprised of a substantially unpigmented emulsion aggregation toner, while the toner or toners of the xerographic image are comprised of the same emulsion aggregation toner material as the differential gloss finish toner except including coloring agents therein such as dyes or pigments and optionally having a differing crosslinked gel content. However, it should be mentioned that the toners of the xerographic image might be different from that of the differential gloss finish toner.

By using a transparent toner that has a tunable gloss level, which can range from matte to very high gloss, as a finish coating material on a xerographic image, it is now possible for xerographic images to be easily produced with differing gloss properties across the image. Such is a significant step in making xerographic images with properties and features similar to those obtainable in the more expensive offset printing procedures.

EXAMPLES

Embodiments of the invention will be further illustrated by way of the following examples.

Latex Preparation:

Latex A: St/BA/AA

A polymeric or emulsion latex (A) was prepared by the emulsion polymerization of styrene/butyl acrylate/acrylic acid (82/18/2) in a nonionic surfactant solution (3%) as follows. 93.19 kg of styrene, 20.46 kg of butyl acrylate, 2273 grams of acrylic acid, 3.98 kg of dodecanethiol and 1136 grams of carbon tetrabromide were mixed in a 50 gallon tank for 5 mins at room temperature (phase 1). In a 100 gallon reactor, 170 kg of deionized water containing 2557 grams of sodium dodecyl benzene sulfonate anionic surfactant (NEOGEN R™, which contains 60% of active component) and 2443 grams of polyoxyethylene nonyl phenyl ether nonionic surfactant (ANTAROX 897™, 70% active component) was stirred until the anionic surfactant was dissolved. 1136 grams of ammonium persulfate initiator were added and stirred until dissolved. The organic phase (phase 1) was then added to the aqueous phase with a nitrogen pressure. The emulsion was then polymerized at 70° C. for 6 hours while being stirred at 125 rpm. The resulting latex, 60% water and 40% (weight percent throughout) solids, was comprised of a copolymer of polystyrene/polybutyl acrylate/polyacrylic acid, 82/18/2. The Tg of the latex dry sample was 57.0° C., as measured on a DuPont differential scanning calorimeter (DSC). The latex had a weight average molecular weight (Mw) of 21,300 and a number average molecular weight (Mn) of 6,400, each as determined on a Hewlett Packard GPC.

Latex B: Crosslinked St/BA/AA

Another latex emulsion (B) comprised of crosslinked polymer particles was prepared in accordance with the above procedure from 470.0 grams of styrene, 30.0 grams of divinyl benzene, 100.0 grams of butyl acrylate, and 12.0 grams of acrylic acid with the exception that the chain transfer agents, carbon tetrabromide and dodecanethiol were excluded.

Latex C: St/BA/CEA

A latex emulsion (C) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™ (anionic emulsifier) and 387 kilograms of deionized water was prepared by mixing for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion was prepared in the following manner. 315.7 kilograms of styrene, 91.66 kilograms of butyl acrylate, 12.21 kilograms of β-CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form seeds, wherein "seeds" refer, for example, to the initial emulsion latex added to the reactor, prior to the addition of the initiator solution while being purged with nitrogen. The above initiator solution was then slowly charged into the reactor forming about 5 to about 12 nanometers of latex "seed" particles. After 10 minutes, the remainder of the emulsion was continuously fed in using metering pumps.

After all of the above was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron volume average diameter resin particles of styreneibutylacrylate/β-CEA suspended in an aqueous phase containing the above surfactant. The molecular properties resulting for the resin latex throughout were $M_w$ of 39,000, $M_n$ of 10,800, as measured by a Gel Permeation Chromatograph, and a midpoint Tg of 55.8° C., as measured by a Differential Scanning Calorimeter, where the midpoint Tg is defined as the halfway point between the onset and the offset Tg of the polymer.

Latex D: Crosslinked St/BA/CEA

A crosslinked latex emulsion (D) comprised of polymer particles generated from the emulsion polymerization of styrene, butyl acrylate and beta carboxy ethyl acrylate (β-CEA) was prepared as follows. A surfactant solution of 120 grams of DOWFAX™ 2A1 (anionic emulsifier—55 percent) and 10 kilograms of deionized water was prepared by mixing for 10 minutes in a stainless steel holding tank. The holding tank was then purged with nitrogen for 5 minutes before transferring the mixture resulting into the reactor. The reactor was then continuously purged with nitrogen while the reactor contents were being stirred at 100 RPM. The reactor was then heated to 76° C., and held there for a period of 1 hour.

Separately, 162 grams of ammonium persulfate initiator were dissolved in 900 grams of deionized water.

Also separately, a monomer emulsion was prepared in the following manner. Seven (7) kilograms of styrene, 3.78 kilograms of butyl acrylate, 324 grams of β-CEA, 108 grams of divinyl benzene (DVB), 188 grams of DOWFAX™ (anionic surfactant), and 4.6 kilograms of deionized water were mixed to form an emulsion. One percent of the above emulsion was then slowly fed into the reactor while being purged with nitrogen containing the aqueous surfactant phase at 76° C. to form "seeds." The initiator solution was then slowly charged into the reactor, and after 40 minutes the remainder of the emulsion was continuously fed in using metering pumps over a period of 3 hours.

Once all the monomer emulsion was charged into the main reactor, the temperature was held at 76° C. for an additional 4 hours to complete the reaction. Full cooling was then applied and the reactor temperature was reduced to 35° C. The resulting product was then collected into a holding tank. After drying the latex, the resin latex onset Tg was 53.5° C. The latex was comprised of 40 percent crosslinked resin, 58.5 percent water and 1.5 percent anionic surfactant. The resin ratio was 65:35:3 pph:1 pph of styrene:butyl acrylate:β-CEA:DVB. The mean particle size of the resin gel (crosslinked resin) latex was 110 nanometers as measured on a disc centrifuge.

Toner Preparation:

Toner 1: Clear Glossy Toner Made from Latex A 260 grams of the above anionically charged latex A was simultaneously added with a cationic surfactant solution comprising 2.7 grams of cationic surfactant (SANIZOL B) and 240 grams of water to 400 grams of water while being polytroned at 5000 rpm for a period of 3 minutes, using an IKA homogenizer. The mixture is transferred into a reaction kettle equipped with a stirrer, and while stirring the temperature is raised at 1.0° C./min to a temperature of 50° C. (below the Tg of the resin) and held there for a period of 1.75 hrs, whereby the volume average particle size obtained was 6.6 microns with a size distribution as conventionally measured by GSD (geometric standard deviation) of 1.18, as measured by the Coulter Counter. 45 milliliters of 20% anionic surfactant solution is then added to the reactor and the reactor temperature is further raised to a temperature of 93° C. and held there for a period of 4 hrs, after which the reactor content was cooled down. The particle size obtained was 7.0 microns with a GSD of 1.20. The particles were then washed several times with water to remove the surfactant, followed by drying on a freeze dryer.

Toner 2: Clear Matte Toner Made from Latex A+Latex B:

220 grams of the above latex A was mixed with 40 grams of crosslinked latex B and the latex blend was simultaneously added with a cationic surfactant solution comprising 2.7 grams of cationic surfactant (SANIZOL B) and 240 grams of water to 400 grams of water while being polytroned at 5000 rpm for a period of 3 minutes, using an IKA homogenizer. The mixture is transferred into a reaction kettle equipped with a stirrer, and while stirring the temperature is raised at 1.0° C./min to a temperature of 50° C. (below the Tg of the resin) and held there for a period of 2.0 hrs, whereby the volume average particle size obtained was 6.3 microns with a size distribution as conventionally measured by GSD (geometric standard deviation) of 1.20, as measured by the Coulter Counter. 45 milliliters of 20% anionic surfactant solution is then added to the reactor and the reactor temperature is further raised to a temperature of 95° C. and held there for a period of 6 hrs, after which the reactor content was cooled down. The particle size obtained was 6.7 microns with a GSD of 1.20. The particles were then washed several times with water to remove the surfactant, followed by drying on a freeze dryer.

Toner 3: Black matte toner made from Latex A+Latex B:

A latex blend was produced, consisting of 70% by weight of the uncrosslinked latex (Latex A) plus 30% by weight of the crosslinked latex (Latex B) described above. An aqueous dispersion of REGAL 330 Carbon Black pigment was added to the latex blend so that the resulting mixture contained 5% by weight of solids REGAL 330, and 95% by weight of solids St/BA/AA polymer blend. The blend of latex and pigment was then aggregated, coalesced, washed and dried into approximately 7 micron sized toner particles.

Toner 4: Clear Glossy Toner Made from Latex C 310 grams of the above prepared latex emulsion (Latex C) was added to 600 milliliters of water with high shear stirring by means of a polytron. To this mixture was added 15 grams of a poly aluminum chloride (PAC) solution containing 1.5 grams of PAC (10 percent solids), and 10 grams of 0.2 molar nitric acid, over a period of 1 minute, and blended at a speed of 5,000 rpm for a period of 3 minutes. The resulting mixture was transferred to a 2 liter reaction vessel and heated at a temperature of 47° C. for 120 minutes resulting in aggregates of a size of 6 microns and a Geometric Standard Deviation (GSD) of 1.19. To the toner aggregates were added 130 grams of the above prepared latex followed by stirring for an additional 90 minutes; the temperature was held at 47° C. The particle size of the aggregates was found to be 6.2 microns with a GSD of 1.19.

The pH of the resulting mixture was then adjusted from 2 to 7.9 with aqueous base solution of 4 percent sodium hydroxide and allowed to stir for an additional 15 minutes. Subsequently, the resulting mixture was heated to 93° C. and retained there for a period of 1 hour where the particle size measured was 6.2 microns with a GSD of 1.20. This was followed by the reduction of the pH to 5.8 with 4 percent nitric acid solution and allowed to stir for an additional 40 minutes. The particle size was 6.2 microns with a GSD of 1.20. The pH of the mixture was further decreased to 5, and allowed to coalesce for an additional 1 hour resulting in particles with a size of 6.3 microns and a GSD of 1.21. The reactor was then cooled down to room temperature and the particles were washed 4 times with deionized water. The toner particles were dried on a freeze dryer at a temperature of −80° C. for a period of 2 days.

Toner 5: Clear Glossy Toner Made from Latex C:

390.0 grams of the latex emulsion (Latex C) was added to 600 milliliters of water with high shear stirring by means of a polytron. To this mixture was added 12 grams of a poly aluminum chloride (PAC) solution containing 1.2 grams of PAC (10% solids) and 6.0 grams of 0.2 molar nitric acid, over a period of 1 minute, followed by the addition of 11.3 grams of cationic surfactant solution containing 1.3 grams of SANIZOL B (60% active ingredients) and 10 grams of deionized water and blended at a speed of 5,000 rpm for a period of 2 minutes. The mixture was transferred to a 2 liter reaction vessel and heated at a temperature of 50° C. for 100 minutes obtaining an aggregate size of 5.8 microns and a GSD of 1.19. The pH of the mixture is then adjusted from 2.0 to 5.9 with aqueous base solution of 4% sodium hydroxide and allowed to stir for an additional 15 minutes. Subsequently, the resulting mixture was heated to 85° C. and retained there for a period of 4 hours before cooling down to room temperature, about 25° C. The toner slurry pH was then further adjusted to 11.0 with a base solution of 6.8% potassium hydroxide and stirred for 1 hr followed by filtration and reslurring of the wet cake in 1 liter of water. The process of adjusting the pH was carried out two more times followed by two water washes. The wet cake was then dried in a freeze dryer. The final toner product had a particle size of 6.1 microns in volume average diameter and with a particle size distribution of 1.21 both as measured on a Coulter Counter.

Toner 6: Clear Matte Toner Made from Latex C+Latex D 318.0 grams of the Latex C was mixed with 78 grams of crosslinked Latex D and then added to 600 milliliters of water with high shear stirring by means of a polytron. To this mixture was added a 12 grams of poly aluminum chloride (PAC) solution containing 1.2 grams of PAC (10% solids) and 6.0 grams of 0.2 molar nitric acid, over a period of 1 minute, followed by the addition of 11.3 grams of cationic surfactant solution containing 1.3 grams of SANIZOL B (60% active ingredients) and 10 grams of deionized water and blended at speed of 5,000 rpm for a period of 2 minutes. The mixture was transferred to a 2 liter reaction vessel and heated at a temperature of 50° C. for 100 minutes obtaining an aggregate size of 6.0 microns and a GSD of 1.20. The pH of the mixture is then adjusted from 2.0 to 5.9 with aqueous base solution of 4% sodium hydroxide and allowed to stir for an additional 15 minutes. Subsequently, the resulting mixture was heated to 95° C. and retained there for a period of 4 hours before cooling down to room temperature, about 25° C. The particle size obtained was 6.1 microns with a GSD of 1.20. The toner was washed 4 times with deionised water and freeze dried. The final toner product was comprised of 80 percent of the polymer of latex C and 20 percent of the polymer of latex D.

Example 1

Off-line Application of a Glossy Finish Coating to a Matte Image.

Matte color images were produced by printing a 13×10 cm solid red patch on XEROX IMAGE LX paper with a 4850 highlight color printer. The gloss of the images was measured according to TAPPI standard T480 at a 75° angle of incidence and reflection, using a NOVO-GLOSS® Statistical Glossmeter from Paul N. Gardner Co., Inc. The gloss of the fused red toner patch from the 4850 printer was 2.4±0.1 ggu. (A gloss of less than 10 ggu is considered matte).

A glossy spot varnish patch was added to the matte images as follows. A xerographic developer for the above transparent emulsion aggregation toner (Toner 1) was produced by mixing 5% by weight of the toner with a suitable electrophotographic carrier, such as, for example, a 90 micron diameter ferrite core spray coated with 0.5 weight percent of a terpolymer of poly(methyl methacrylate), styrene, and vinyltriethoxysilane, and roll milling for 15 mins, which produced a tribocharge on the toner of −15.0 μcoul/g. 400 g of this developer was introduced into the developer housing of a MITA DC-111 copier that had been modified to eliminate its fuser. Unfused images of the transparent toner 1 were produced in the form of a 6.5×6.5 cm patch on top of the 4850 matte red image by passing the 4850 images through the MITA copier. A single pass produced an unfused image of transparent emulsion aggregation toner 1 with a TMA of 0.55 mg/cm$^2$, while two passes produced a TMA of 1.1 mg/cm$^2$. The unfused images appeared as an opaque white patch on top of the red 4850 patch.

The images were then passed through a soft-roll color fuser operating at 170° C. and a process speed of 160 mm/sec. After fusing, the patch of emulsion aggregation toner 1 became transparent, and did not produce any visible shift in the color of the underlying 4850 red patch. It did, however, dramatically increase the gloss. After passing through the fuser, the gloss of the unvarnished 4850 toner increased slightly to 9.6±0.6 ggu. The gloss of the patch with the emulsion aggregation spot varnish increased to 46.6±1.6 ggu for 0.55 mg/cm$^2$ TMA, and to 66.2±2.4 ggu for the 1.1 mg/cm$^2$ TMA.

Example 2

On-line Application of Glossy Spot Varnish to a Matte Image.

A patch of unfused matte black emulsion aggregation toner (Toner 3) on XEROX IMAGE LX paper was produced as follows. A xerographic developer for the black emulsion aggregation toner 3 was produced by mixing 5% by weight of the black toner with a suitable electrophotographic carrier, such as, for example, a 90 micron diameter ferrite core spray coated with 0.5 weight percent of a terpolymer of poly(methyl methacrylate), styrene, and vinyltriethoxysilane, and roll milling for 15 mins, which produced a tribocharge on the toner of −12.6 μcoul/g. 400 g of this developer were introduced into the developer housing of a MITA DC-111 copier, which had been modified to eliminate its fuser. Unfused images of various geometries can be produced by placing the appropriate target image on the MITA copier platen. Unfused images of the black toner 3 with various toner mass per unit area (TMA) were produced in the form of a 13.0×6.5 cm patch by passing the IMAGE LX paper repeatedly through the MITA copier. Two passes produced an unfused image with a TMA of 0.55 mg/cm$^2$, while four passes produced a TMA of 1.1 mg/cm$^2$.

The black developer was then removed from the MITA copier and replaced with a developer for the glossy transparent emulsion aggregation toner (Toner 1) consisting of 5% by weight of toner 1 with a suitable electrophotographic carrier, such as, for example, a 90 micron diameter ferrite core spray coated with 0.5 weight percent of a terpolymer of poly(methyl methacrylate), styrene, and vinyltriethoxysilane. 400 g of this developer were introduced into the MITA developer housing. Unfused images of the transparent toner 1 were produced in the form of 6.5×6.5 cm patches, which were deposited on top of the right hand half of the 13×6.5 cm patch of unfused black toner 3, by passing the previously made unfused images of black toner 3 through the MITA copier. One pass deposited an additional TMA of 0.50 mg/cm$^2$ of toner 1, while two passes deposited an additional TMA of 1.0 mg/cm$^2$. The resulting unfused images correspond to the type of image produced in an on-line system designed to produce spot varnish; i.e., a matte, pigmented unfused toner which in designated areas is overcoated with a glossy transparent unfused toner, is deposited on paper prior to fusing.

The images were then passed through a soft-roll color fuser as in Example 1, operating at 155° C. and a process speed of 160 mm/sec. After fusing, the left side of the toner patch was visibly matte, while the right side was visibly glossy, while both sides appeared equally black in color. The gloss values of the left and right halves of the images were measured according to TAPPI standard T480 at a 75° angle of incidence and reflection, using a NOVO-GLOSS® Statistical Glossmeter from Paul N. Gardner Co., Inc. Results for various TMA combinations are recorded in Table 1.

TABLE 1

Gloss of Images

| TONER | No. Passes on MITA | TMA (mg/cm$^2$) | Gloss (ggu) |
|---|---|---|---|
| Black Toner 3 | 2X | 0.55 | 22.8 ± 2.6 |
| +Transparent Toner 1 | 1X | +0.50 | 64.6 ± 3.1 |
| Black Toner 3 | 2X | 0.55 | 23.3 ± 3.0 |
| +Transparent Toner 1 | 2X | +1.0 | 71.6 ± 2.4 |
| Black Toner 3 | 4X | 1.1 | 24.3 + 2.4 |
| +Transparent Toner 1 | 1X | +0.50 | 69.3 + 3.3 |

Therefore, even though the matte and glossy toner layers are fused at the same time, a significant difference in gloss (40-50 ggu) develops between those areas that have a transparent emulsion aggregation spot varnish as the topmost layer, and those areas with no spot varnish.

While the invention has been described in conjunction with exemplary embodiments, these embodiments should be viewed as illustrative, not limiting. Various modifications, substitutes, or the like are possible within the spirit and scope of the invention.

What is claimed is:

1. A method of forming a xerographic image having at least one portion with a gloss different from a gloss of another portion of the xerographic image, comprising:

xerographically forming an image comprised of toner on a surface of a substrate; and forming a finish over the image comprised of toner at the at least one portion, the finish comprised of a differential gloss finish coating material that has a gloss different from that of the image comprised of toner, wherein the differential gloss finish coating material is substantially free of coloring agents, wherein the differential gloss finish coating material is comprised of an emulsion aggregation toner having linear portions and including crosslinked portions in an amount of from about 25% by weight to about 50% by weight of the toner.

2. The method according to claim 1, wherein the method further comprises forming the emulsion aggregation toner by emulsion polymerizing a monomer or mixture of monomers to form particles, and subsequently aggregating the particles.

3. The method according to claim 1, wherein the step of xerographically forming the image comprised of toner includes forming an electrostatic latent image on an electrophotographic imaging member, developing the latent image by depositing toner particles thereon, and transferring the developed image comprised of toner to the surface of the substrate.

4. The method according to claim 1, wherein the step of forming the finish comprises applying the differential gloss finish coating material to a surface the image comprised of toner that has been earlier formed and fused.

5. The method according to claim 1, wherein the step of forming the finish comprises applying the differential gloss coating material as a first image on a surface of an electrophotographic imaging member or intermediate transfer member, subsequently xerographically forming the image comprised of toner upon the first image, and transferring the images from the surface of the electrophotographic imaging member or intermediate transfer member to the surface of the substrate.

6. The method according to claim 1, wherein the differential gloss finish coating material is substantially transparent following fusing.

7. The method according to claim 1, wherein the method further comprises a fusing step after formation of the finish, and wherein the differential gloss finish coating material is substantially free of pigments that adversely affect the transparency of the toner following the fusing.

8. The method according to claim 1, wherein the emulsion aggregation toner is comprised of a polymer resin selected from poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene butyl acrylate beta carboxy ethyl acrylate), poly(styrene butadiene beta carboxy ethyl acrylate), poly (styrene isoprene beta carboxy ethyl acrylate), poly(styrene butyl acrylate, acrylonitrile beta carboxy ethyl acrylate), and poly(styrene butyl acrylate, divinyl benzene beta carboxy ethyl acrylate).

9. The method according to claim 1, wherein the emulsion aggregation toner is comprised of a styrene, butyl acrylate and carboxylic acid copolymer.

10. The method according to claim 1, wherein the gloss of the finish is at least 5 gloss units different from the gloss of the image comprised of toner.

11. The method according to claim 1, wherein the gloss of the finish is at least 10 gloss units different from the gloss of the image comprised of toner.

12. The method according to claim 1, wherein the step of forming the finish over the image includes forming a first finish having a first gloss at the at least one portion of the image, and forming a second finish having a second gloss, different from the first gloss, at least one of the another portion of the image.

13. The method according to claim 12, wherein the at least one portion and the at least one of the another portion are adjacent portions of the image.

14. The method according to claim 12, wherein the first gloss and the second gloss differ by at least about 5 gloss units.

15. The method according to claim 12, wherein the first gloss and the second gloss differ by at least about 10 gloss units.

16. A method of preparing a xerographic image having different gloss properties at different portions of the image, comprising:

xerographically forming an image comprised of toner on a surface of a substrate; and at selected portions of the image, and not at an entirety of the image, applying an emulsion aggregation toner that is substantially free of coloring agents and substantially free of pigments that adversely affect the transparency of the toner following fusing of the toner, has linear portions and includes crosslinked portions in an amount of from about 25% by weight to about 50% by weight of the toner.

* * * * *